United States Patent [19]

Stolarczyk

[11] 4,092,643

[45] May 30, 1978

[54] SECURITY DEVICE

[75] Inventor: Larry G. Stolarczyk, Raton, N. Mex.

[73] Assignee: A. R. F. Products, Inc., Raton, N. Mex.

[21] Appl. No.: 571,585

[22] Filed: Apr. 25, 1975

[51] Int. Cl.[2] ..... G08B 1/08; G08B 19/00

[52] U.S. Cl. ..... 340/416; 340/224; 340/276; 340/420

[58] Field of Search ..... 340/416, 224, 276, 420, 340/408, 215, 277, 278, 279, 283, 287, 288, 294, 248 D, 248 P, 409, 384 E; 331/64, 65, 66, 54; 179/5 R

[56] References Cited

U.S. PATENT DOCUMENTS

| | | | |
|---|---|---|---|
| 3,390,234 | 6/1968 | Glidden | 340/420 |
| 3,461,241 | 8/1969 | Menke | 340/416 X |
| 3,493,967 | 2/1970 | Ressler | 340/416 |
| 3,588,865 | 6/1971 | Hansen | 340/276 |
| 3,699,569 | 10/1972 | Lee | 340/276 |
| 3,703,000 | 11/1972 | Kaplan et al. | 340/276 |
| 3,810,097 | 5/1974 | Muir et al. | 340/416 |
| 3,858,194 | 12/1974 | Jedynak et al. | 340/276 |
| 3,930,226 | 12/1975 | Plumberg | 340/64 |

*Primary Examiner*—John W. Caldwell, Sr.
*Assistant Examiner*—Donnie L. Crosland
*Attorney, Agent, or Firm*—Burmeister, York, Palmatier, Hamby & Jones

[57] ABSTRACT

A security system in which fire or intrusion signals may be impressed on a first and a second monostable oscillator connected in timing circuits, the first monostable oscillator producing an output for a first limited time period to excite an alarm, and coincidently in time a second monostable oscillator producing an output of shorter second time period for delaying actuation of the alarm to permit the operator to deactivate the unit prior to actuation of the alarm, each of the monostable oscillators using an integrated circuit and being reset by application of power to the unit and during function key switch position change. The fire channel has top priority over any other functional characteristics of the master control.

14 Claims, 3 Drawing Figures

SECURITY DEVICE

Figure 1:
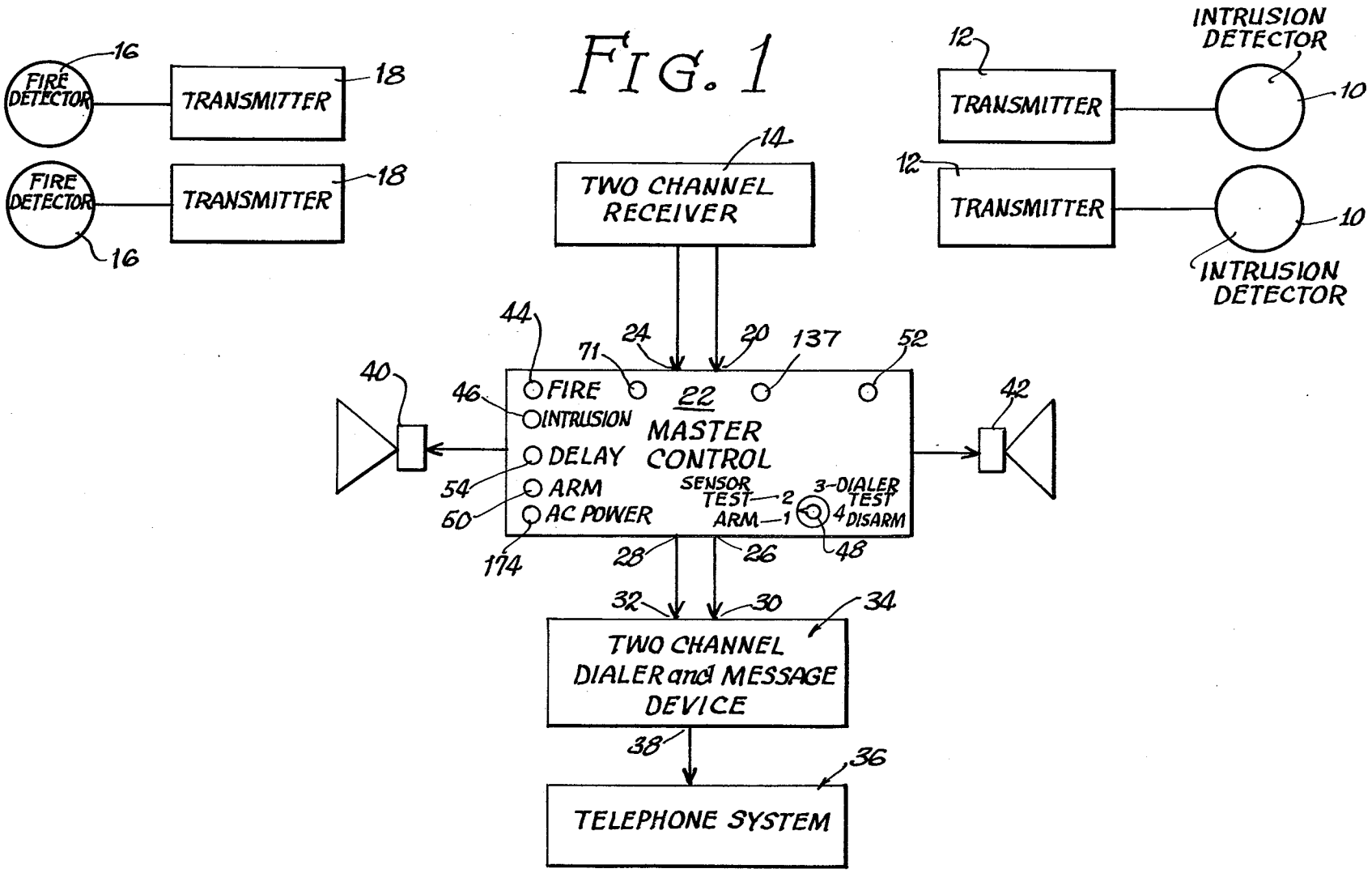

The present invention relates to security systems, that is, systems for detecting an intrusion, fire, smoke, or water leakage. More particularly, the present invention relates to the control device for receiving electrical signals from sensors designed to detect a condition, the control device responding to the output of such sensors to actuate an alarm.

Prior to the present invention, security devices have been provided with sensors in the form of switches, light beams and photocells, ultra-sonic sources and detectors, and the like. Such sensors have been used to actuate an alarm, often exterior of the secured area, and occasionally within the secured area, and the alarm may include lights, or an electrical signal transmitted over a telephone line to a manned security station. Some prior security systems also utilize radio frequency transmitters and receivers to conduct the output of the sensor to a control unit which responds by actuation of an alarm. Often the control unit will provide a time delay to enable an operator to enter the secured area and deactivate the system before the alarm sounds, generally by use of the key switch.

The control units used heretofore have generally simply actuated an alarm in response to a signal from a sensor, and it was necessary for an operator to reset the system in order to terminate the alarm. Such systems also generally provide only a single delay period which must be long enough to permit an operator to enter a secured area and deactivate the system, or alternatively, to activate the system and leave the secured area. Prior systems also are generally activated by either fire or intrusion sensor signals, and if deactivated, the system will not respond to either fire or intrusion signals. In addition, such prior systems have been costly to construct and accordingly have been limited in versitility, such as the ability to test sensors and alarms.

It is an object of the present invention to provide a master control for a security system in which the alarm is actuated for a period of time, and thereafter automatically resets itself into condition for receiving a new sensor generated signal to produce a new alarm.

It is a further object of the present invention to provide such a master control with means for delaying actuation of the alarm for a period shorter than the period of the alarm, a number of delay periods being selectable to facilitate entrance to the secured area, exit from the secured area, or testing of the sensors and alarms.

It is a further object of the present invention to provide a master control for a security system with means for testing the sensors and the alarms which eliminate substantially all delay incorporated in the system, but which provides delay between sensing of a condition and actuation of the alarm in its normal armed condition.

It is a further object of the present invention to provide a master control which is inexpensive and versatile, and which utilizes integrated timing circuits for actuation of an alarm and for providing a plurality of selectable delay times between sensing of a condition and actuation of the alarm.

The inventor has provided a security device in which a first monostable oscillator is connected to a sensor, and the monostable oscillator changes state in response to an output from the sensor to produce an output potential on the output of the oscillator for a first limited period of time. The output potential is coupled to an alarm system and is adapted to actuate that alarm system. The security system has a second monostable oscillator with an input coupled to the sensor which also produces an output potential on an output terminal thereof for a second limited period of time which is shorter than the first period of time, and means actuated by the second monostable oscillator for preventing actuation of the alarm during the period of output from the second monostable oscillator. The second monostable oscillator is a timer, and the second period in which the second monostable oscillator produces an output is selectable for purposes of providing ingress and egress delays and for purposes of providing sensor delays, or the delay period may be substantially eliminated.

The present invention will be more fully appreciated from the following specification, particularly when viewed in the light of the drawings, in which:

FIG. 1 is a block schematic diagram of a security system constructed according to the teachings of the present invention; and FIGS. *2a* and *2b* comprises a schematic electrical circuit diagram of the master control unit illustrated in FIG. 1.

FIG. 1 illustrates the overall security system constructed according to the present invention. A plurality of intrusion detectors 10 are utilized to excite portable transmitters 12 in order to sense the occurrence of an intrusion. The intrusion detectors themselves may be magnetic switches, ultrasonic wave actuated switches, or merely a switching function achieved by the breaking of a conductor. In any event, an intrusion actuates the portable transmitter 12 connected to that detector, and the radio frequency signal emitted by the transmitter 12 is received by a two channel receiver 14 and an electrical signal appears at the output of one channel of that receiver.

In like manner, a plurality of fire detectors 16 are utilized to detect the presence of a fire at various locations about the area in which the security system is to operate. Each of the fire detectors 16 is connected to a portable transmitter 18, and the transmitter 18 is tuned to emit radio frequency signals at the frequency of the second channel of the receiver 14. The two channel receiver 14 produces a separate output from the second channel in response to signals received from the fire detection transmitters 18.

The intrusion output of the two channel receiver 14 is connected to an input terminal 20 of a master control 22, and the fire output of the two channel receiver 14 is connected to a separate input terminal 24 of the master control. The master control 22 has two output terminals 26 and 28 which are electrically connected to two input terminals 30 and 32 of a two channel dialer and message device 34. When the master control 22 receives an input on its input terminal 24 evidencing the detection of a fire, assuming the master control is in the arm or disarm condition, an output appears upon the terminal 28 of the master control and the input 32 of the two channel dialer and message device. Accordingly, the dialer and message device, which is connected to the telephone system 36, dials the number of the telephone system to be informed of the presence of a fire in the secured area and generates the proper audio message to be transmitted to that number to advise of the presence of a fire detection in the secured area. The two channel dialer and message device has an output terminal 38 connected to the telephone system 36 for this purpose.

The master control also is connected to an outside loudspeaker or alarm 40 and an inside loudspeaker or alarm 42 to raise the alarm of a fire in the vicinity of the secured area. Further, the master control has an indicator lamp 44 which indicates a fire detection condition.

In the event of an intrusion detection, the master control places a signal on the input terminal 30 of the two channel dialer and message device, and the dialer dials the number in the telephone system which is to be notified of the presence of an intrusion detection in the secured area and an appropriate audio message is placed upon the telephone line to that number. Likewise, the master control excites the outside alarm 40 and the inside alarm 42. In addition, an intrusion indicator lamp 46 on the master control visually indicates the detection of an intrusion.

The master control 22 also has a selector switch 48 with three separate ganged sections designated 48A, 48B and 48C. The selector switch 48 must be in the first position in order to arm the security system for intrusion signals, however, fire signals are active in both arm and disarm. The selector switch may be placed in the fourth position to disarm the security system with respect to intrusion sensor signals, thereby making it insensitive to the detection of sensor transmitted intrusion signals, however, the system is not inhibited with respect to fire sensor transmissions and emergency intrusion or fire front panel switches, as described hereinafter. The second position of the switch 48 is especially designed for the testing of the fire and intrusion channels, and the third position of the switch 48 is especially designed for testing of the dialer and message device.

The master control 22 is provided with a lamp 50 for indicating that the master control is armed. The arm lamp 50 will turn off if (a) the power switch is off, (b) the line power is off, but the power switch is in the "on" position — the unit operating on standby power, and (c) if the power supply fails, the arm lamp will turn off indicating trouble. In addition, the master control has a delay switch 52 which may be actuated to eliminate the normal delay in the arm position of the control switch 48. The master control provides a time interval between the sensing of an intrusion condition (there is no appreciable master control activation delay on any fire sensor signals) and the excitation of the dialer and message device 34 or alarms 40 and 42, and when the master control is in the delay condition, a delay lamp 54 indicates this fact. If a fire sensor sends a signal to the master control while the control is in delay, the fire signal has top priority, and the delay is fast timed out, as explained hereinafter.

Figure 2A:
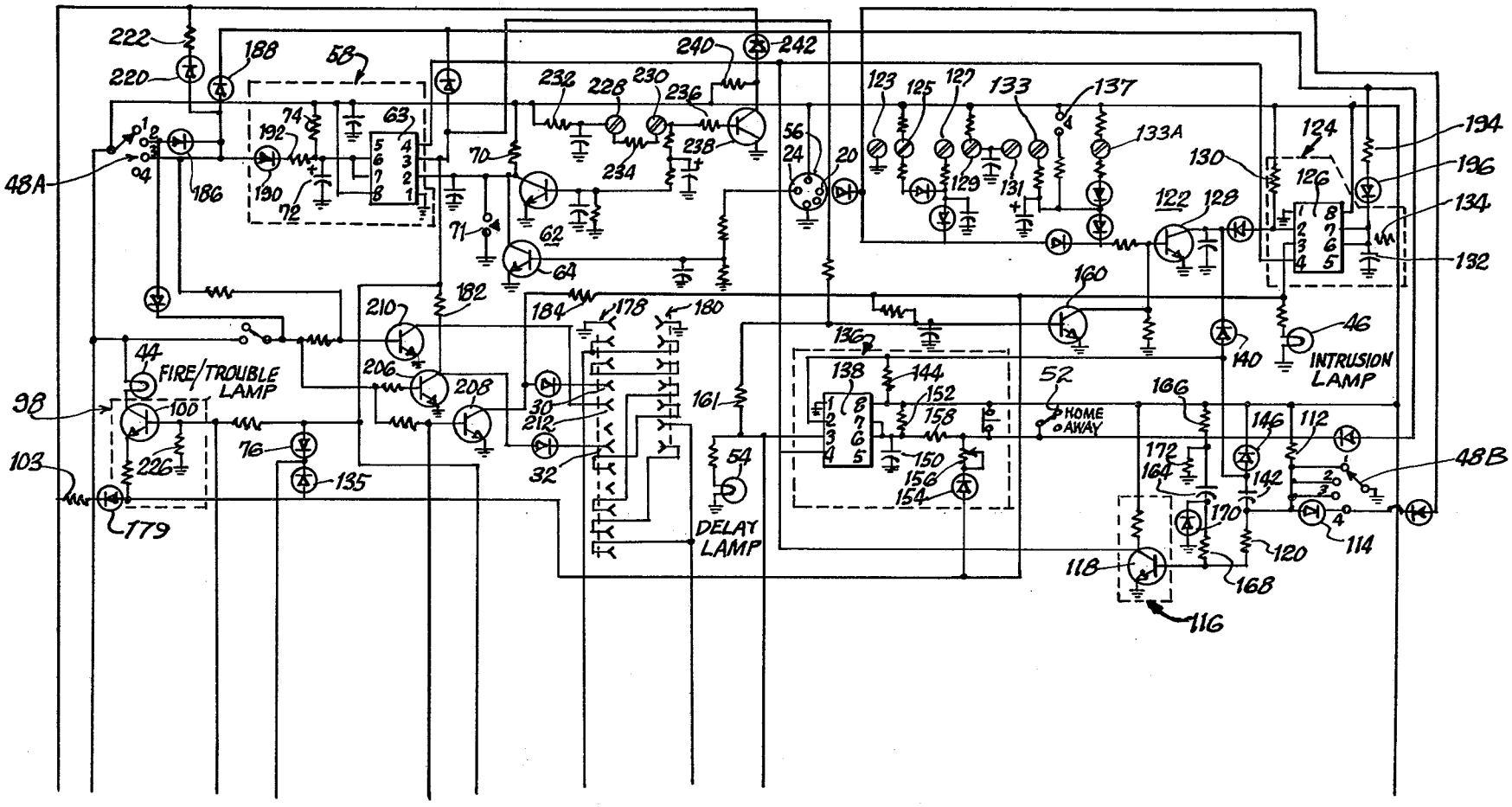
Figure 2B:
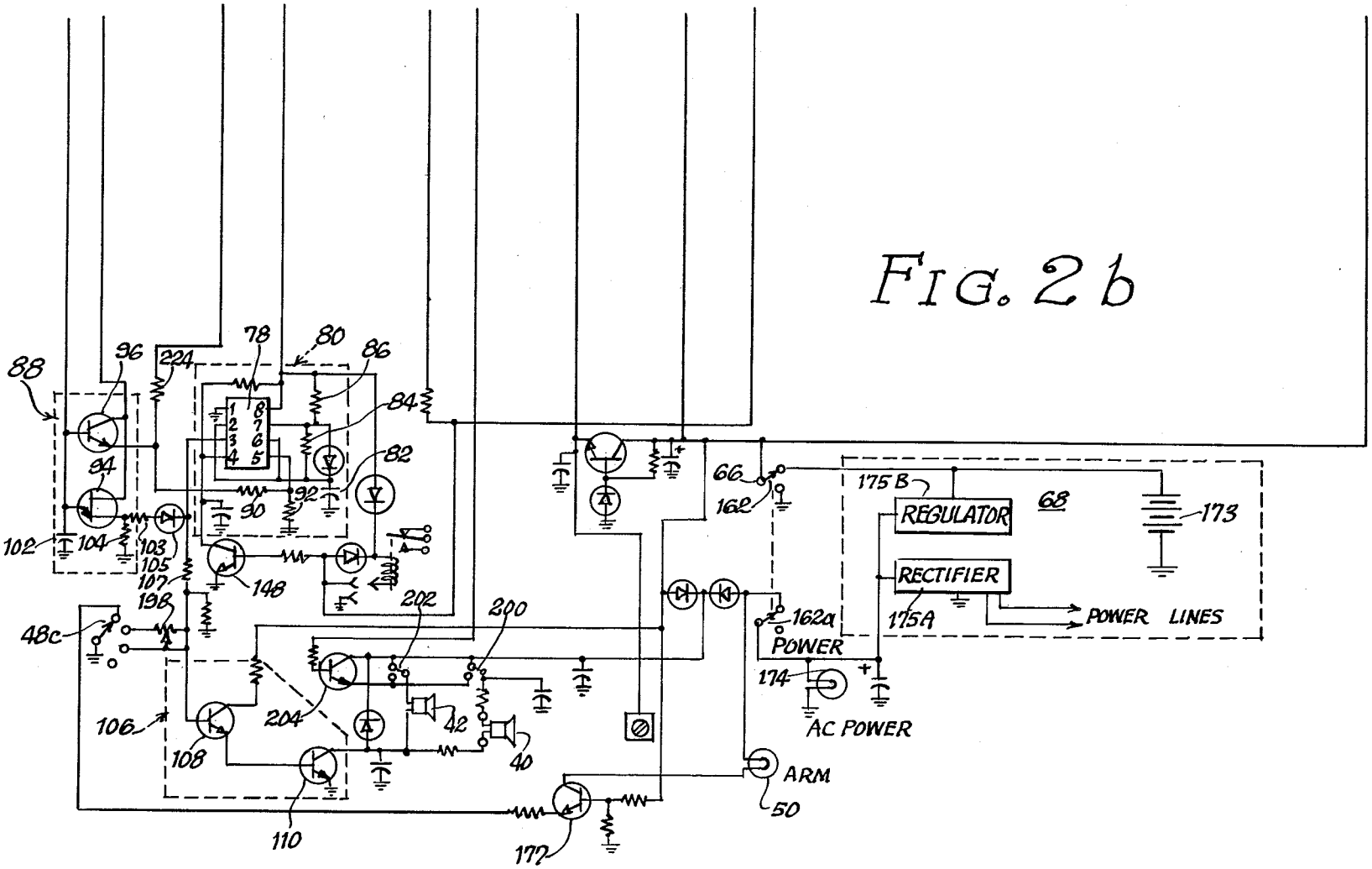

As illustrated in FIG. 2, the master control 22 has a plug 56 which is connected to the two channel receiver 14 and has a terminal 24 for the fire input from the receiver and the terminal 20 for the intrusion input from the receiver. The fire input terminal 24 is connected to a fire channel monostable oscillator 58 through an amplifier 62. The monostable oscillator 58 employs an integrated circuit 63 connected in a monostable mode. The integrated circuit 63 has eight pins, the first pin being connected to the common ground, and the second or trigger pin forming the input terminal for the monostable oscillator. The second pin is directly connected to the collector of a transistor 64 of the amplifier 62, the base of the transistor 64 being connected to the fire input terminal 24, and the emitter of the transistor 64 being connected to the common ground. The collector of the transistor 64 is connected to the positive terminal 66 of the power source 68 through a resistor 70. Accordingly, a positive pulse appearing on the input terminal 24 of the master control 22 results in an increase in current through the transistor 64, thus driving terminal 2 of the integrated circuit 63 downward. The integrated circuit 63 is triggered by a negative going trigger pulse applied to pin 2 thereof, which may be generated by transistor 64 or the closing of emergency fire switch 71 located on the front panel and connected between pin 2 and the negative terminal of the power source 68.

Integrated circuit 63 has a third pin which is the output terminal of the monostable oscillator 58. The fourth pin of the integrated circuit 63 is for a reset pulse, and this circuit will be described hereinafter. The fifth pin in some cases is used for the control voltage, but has no connection in the monostable oscillator 58. The sixth and seventh pins are for threshold and discharge functions and these pins are interconnected and connected to the common ground through a capacitor 72. The pins 6 and 7 are also connected to the positive terminal 66 and the power source 68 through a resistor 74 which forms a charging circuit for the capacitor 72. The eighth pin is for the collector potential of the integrated circuit 63, and is connected to the positive terminal 66 of the power source 68.

The monostable oscillator 58 triggers on a negative going input signal applied to pin 2, and the monostable oscillator 58 remains in its triggered state for a time period determined by the capacitor 72 and the resistor 74. At the expiration of said time period, the monostable oscillator 58 returns to its initial state. Pin 3 is low except during the triggered time period when pin 3 remains high. The RC time constant formed by capacitor 72 and resistor 74 are selected to give a triggered period or "on" time for the oscillator 58 of approximately 4 minutes. The integrated circuit 63 used in the particular application described is a Signetics type 555 linear integrated circuit which is readily available commercially.

The output of the monostable oscillator 58 appearing on pin 3 of the integrated circuit 63 is conducted through diode 76 to a second integrated circuit 78 connected in an astable oscillator 80. The integrated circuit 78 is identical to integrated circuit 63, and has eight pins, the eighth pin forming the input terminal for the astable oscillator 80 thereby receiving its power from pin 3 of integrated circuit 63. The first pin of the integrated circuit 78 is grounded, and the second or trigger pin of the integrated circuit is connected to the sixth or threshold pin in order to cause the integrated circuit to trigger itself, and hence free run. A capacitor 82 is connected between ground and the sixth pin, and this capacitor 82 is charged through a first resistor 86 connected between the seventh pin of the integrated circuit 78 and the power from the junction of diodes 76 and 135. The capacitor 82 and resistor 86 determines the time period that pin 3 of integrated circuit 78 is high. Pin 7 of integrated circuit 78 provides a discharge function, and shorts capacitor 82 to ground through a resistor 84 when the pin 3 of integrated circuit 78 is low. The capacitor 82 and resistor 86 determine the time period that pin 3 of integrated circuit 78 is low. The entire oscillation period of the oscillator 80 is thus determined by the sum of the "on" and "off" time periods.

The output of the astable oscillator 80 appears on pin 3 of the integrated circuit 78 and is conducted to a two stage audio amplifier 106 through a resistor 107. The audio amplifier 106 has two transistors 108 and 110 in a Darlington connection, the base of transistor 108 forming the input to the amplifier 106 and the output of the amplifier appearing on the collector of transistor 110. The alarms 40 and 42 are connected in the emitter-collector circuit of the transistor 110. Hence, the system responds to a fire detection signal by exciting the alarms 40 and 42 at a constant audio rate generated by the astable oscillator 80.

When power is first applied to the master control 22, it may result in the monostable oscillator 58 initially assuming the state in which pin 3 of the integrated circuit 63 is high, rather than low. This condition would immediately excite an alarm, but can be avoided by applying a negative going pulse to the trigger pin 4 on excitation of the system.

The positive terminal 66 of the power source 68 is the rotary terminal of a two position switch 162. In the "on" position, terminal 66 is connected to the power source, but in the "off" position it is connected to ground. A reset wave shaper 116 with a transistor 118 is used to generate a negative going pulse to reset the integrated circuit 63 on application of power. Capacitor 164 is connected to the positive terminal 66 of the power source through a resistor 166 and to the base of transistor 118 by resistor 168. The base of transistor 118 is also connected to the stationary terminals of switch section 48B through a resistor 120. A diode 170 is connected to the junction between the capacitor 164 and resistor 168. A resistor 172 is connected between ground and the junction between capacitor 164 and resistor 166. The capacitor 164 is charged through resistor 166 on closing of the switch 162 to connect the terminal 66 with the power source 68. During the period of charging of the capacitor 164, the base of transistor 118 is driven positive, thereby producing a negative going pulse on the collector of transistor 118 which resets the monostable oscillator 58. The transistor 118 collector is held at Vsat during the reset period. When switch 162 is switched to the off position, the capacitor 164 rapidly discharges through resistor 172 and diode 170.

Intrusion detection signals appear on pin 20 of plug 56 of the master control 22 and are conducted through a transistor amplifier 122 to a second monostable oscillator 124. Other intrusion sensors, particularly of the hard wire type, may be connected to two or more of the input terminals 123, 125, 127, 129, 133 and 133A. The second monostable oscillator 124 has an integrated circuit 126 identical to the integrated circuit 63 and connected in a similar circuit to the monostable oscillator 58. Amplifier 122 has a transistor 128 with a grounded emitter and a collector connected to pin 2 of the integrated circuit 126. An emergency intrusion switch 137 is located on the front panel and connected between the positive terminal of the power source 68 and the base of the resistor 128 to permit the operator to excite the alarm manually. Pin 2 is also connected to the positive terminal 66 of the power source 68 through a resistor 130. The monostable oscillator 124 is driven to the state in which a high output appears on pin 3 of the integrated circuit 126 in response to a negative going pulse on the input pin 2 thereof, and will retain this state for a period of time determined by capacitor 132 connected between ground and pins 6 and 7 and resistor 134 connected between pins 6 and 7 and the positive terminal 66 of the power source. Reset pin 4 of integrated circuit 126 is also connected to the collector of transistor 118 in the pulse shaper 116. Hence, monostable oscillator 124 is reset through the same circuit as the first monostable oscillator 58.

Pin 3 of integrated circuit 126 forms the output terminal for the second monostable oscillator 124, and pin 3 is electrically connected through diode 135 to the input terminal, or pin 8, of the astable oscillator 80. Hence, an intrusion detection signal which triggers the second monostable oscillator 124 results in actuation of the audio astable oscillator 80, and driving of the alarms 40 and 42. A warbling sound is produced by a sawtooth generator 88.

The output of the monostable oscillator 124 which appears on pin 3 of integrated circuit 63 is used to actuate the sawtooth generator 88. The sawtooth generator 88 has a unijunction transistor 94 and a second transistor 96 connected as an emitter follower. The base of transistor 96 is connected to the gate of the unijunction transistor 94, and the collector of transistor 96 and upper base of unijunction transistor 94 are connected to the positive terminal 66 of the power source 68. The gate of unijunction transistor 94 is also connected to ground through a capacitor 102, and the low base of unijunction transistor 94 is connected to ground through resistor 104. The emitter of transistor 96 is connected to the pin 5 of integrated circuit 63, and also to ground through the voltage divider resistors 90 and 92. The capacitor 102 is charged through resistor 103 and diode 179 (intrusion alarm only). When the capacitor voltage reaches the unijunction firing point, the unijunction transistor 94 conducts and capacitor 102 discharges through unijunction transistor 94 and resistor 104. The capacitor 102 is then sequentially charged and discharged forming a "near" sawtooth waveform. The sawtooth voltage waveform appearing across capacitor 102 is impressed on the base of the emitter follower transistor 96. The output voltage of transistor 96 is developed across the voltage divider resistors 90 and 92 and modulates the output of the astable oscillator 80.

Hence, the audio signal applied to the amplifier 106 is modulated by the sawtooth generator 88 producing a wailing sound. The unijunction transistor 94 produces an output current at the lower base each time the capacitor 102 discharges. The output current flowing through resistor 104 produces a short duration voltage pulse. The voltage pulse is conducted through resistor 103A and diode 105 to the audio amplifier 106. Thus, when the switch 48C is in either the arm or disarm position, an audio click appears in the speaker output. This click is not noticeable when the master control is in an alarm condition.

It is often desirable that the alarms 40 and 42 respond to an intrusion signal only after a period of delay. A monostable delay oscillator 136 is utilized to provide three separate delay times. The delay monostable oscillator 136 employs an integrated circuit identical to the integrated circuits 63, 78 and 126 connected in a monostable oscillator circuit similar to the oscillator circuits 56 and 124. Reset pin 4 of the integrated circuit 138 is connected to the collector of transistor 118 of the reset pulse shaper 116 to provide initial reset of the monostable oscillator 136. Pin 2 of the integrated circuit 138 forms the input of the delay monostable oscillator, and is electrically connected through a diode 140 to the collector of transistor 128 of amplifier 122, and hence receives the negative going input pulse generated by an intrusion detection simultaneously with pin 2 of the second monostable oscillator 124.

When the delay monostable oscillator 136 produces an output by pin 3 of the integrated circuit 138 going high, this output is impressed upon the base of a transistor 148, which is a transistor switch connected between pin 4 of integrated circuit 78 and ground potential, thereby preventing astable oscillator 80 from functioning. In this manner, during the period in which pin 3 of the integrated circuit 138 of the monostable delay oscillator 136 is high, the alarms 40 and 42 are prevented from operation except for the click from the sawtooth generator 88.

The period during which pin 3 of integrated circuit 138 remains high following actuation by a negative pulse on pin 2 thereof, is always less than the period integrated circuit 126 produces an output on pin 3 thereof, and is determined by the charge on capacitor 150 connected to pins 6 and 7 of the integrated circuit 138. A plurality of different time periods is achieved by providing a plurality of charging circuits for the capacitor 150 through different resistors. One charging circuit utilizes resistor 152 connected between pins 6 and 7 and pin 8 of integrated circuit 138. This charging circuit is designed to provide an exit delay, and one particular construction provides a delay of between 50 and 75 seconds to enable the operator to reset the master control by moving the selector switch from the arm position to any other position and back to arm when exiting from the area.

The selector switch 48 has three ganged sections designated 48A, 48B, and 48C in FIG. 2. All three sections have four stationary terminals, and in section 48B the first, second and third stationary terminals are interconnected and connected to the positive terminal 66 of the power source 68 through a resistor 112, the diode 114 being connected between the fourth stationary terminal of the switch section 48B. The rotary contact of the switch section 48B is grounded. Pin 2 of integrated circuit 138 is connected through capacitor 142 to the stationary terminals 1, 2, 3 and 4 of the second section 48B of the selector switch 48. Capacitor 142 is connected to the positive terminal 66 of the power source 68 through a resistor 144, and hence is charged whenever the rotary contact of switch section 48B is in contact with any of the stationary contacts thereof. When the rotary contact of the switch section 48B is between stationary contacts, however, the capacitor 142 discharges through a diode 146 and resistor 112. Accordingly, when the selector switch is moved to the No. 1 or arm position, the condenser 142 charges through resistor 144 actuating only the monostable delay oscillator 136. When the selector switch is between stationary contacts on 48B, current flows through resistors 112 and 120 into the base of transistor 116 forcing the collector of transistor 116 to the saturation voltage level. This immediately resets monostable oscillators 58, 124 and 136.

A second delay period is provided by the circuit extending from the output terminal of the second monostable oscillator 124 to the capacitor 150 which includes diode 154, adjustable resistor 156, and resistor 158. This circuit provides entrance delay, and in one particular construction is designed to provide a delay of approximately 30 seconds to allow a person to enter the secured area and move the selector switch 48 from position 1 (arm position) to any other position to reset the control. Since the entrance of the person into the secured area will trigger the monostable oscillator 124 and cause pin 3 of integrated circuit 126 to go high, this places a second potential source in parallel with the potential source through resistor 152, thus shortening the charging time for capacitor 150 and the period in which the monostable 136 will produce an output on pin 3 of integrated circuit 138.

In addition, the position delay switch 52 electrically connected between the junction of adjustable resistor 156 and resistor 158 and the positive terminal 66 of the power source 68 forms a third delay time. When this switch 52 is closed, only resistor 158 is in the charging circuit for capacitor 150, and this resistor may be made quite small to provide a very short time delay. Switch 52 is designed to provide only a very short delay, of the order of one or two seconds, in order to achieve substantially immediate actuation of the alarm in the event of an intrusion.

During the period of delay following actuation of the monostable oscillator 124 by an intrusion signal, subsequent intrusion signals are prevented from changing the state of the monostable oscillator 124 by a switch utilizing a transistor 160. The base of the transistor 160 is connected to the output pin 3 of integrated circuit 138 through a resistor 161. The collector of the transistor 160 is connected to the base of transistor 128, and the emitter is connected to the negative terminal of the power source 68.

The power source 68 has a battery 173, a full wave bridge or rectifier 175A and a voltage regulator 175B. The battery 173 has a positive terminal connected to the positive terminal 66 of the voltage regulator 175B, and the output of the full wave bridge 175A is connected to the power lines. An indicator lamp 174 is connected between the positive terminal of the full wave rectifier bridge 175A and ground to indicate when the unit is operating under AC power. The positive terminal of the full wave bridge 175B is connected to the rotary terminal of a switch section 162A which is ganged with section 162. The "arm" lamp 50 is connected between the stationary "on" terminal of switch section 162A and the first terminal of switch section 48C through a switch employing a transistor 177. Since the rotor of switch section 48C is grounded, lamp 50 is illuminated when switch 48 is in arm position and transistor 177 is conducting. The base of transistor 177 is connected to the positive terminal of the power source 175, so lamp 50 requires both the arm position of switch 48 and power from the AC supply 175 to be illuminated.

It will be noted that the terminals 30 and 32 two channel dialer 34 are a part of a connector 178. The terminal 32 is connected to pin 3 of integrated circuit 63 through resistor 182 to conduct the output of monostable oscillator 58 generated by a fire signal to the fire channel of the dialer 34. In like manner, terminal 30 is connected to pin 3 of integrated circuit 126 through a resistor 184 to connect the output of monostable oscillator 124 generated by an intrusion signal to the intrusion channel of the dialer 34. A separate connector 180 is provided for connection to the telephone lines.

The selector switch 48 has a position designated "2" which provides a sensor test. In this position, section 48A connects the positive terminal 66 of the power source 68 through diodes 186 and 188 to the junction of variable resistor 156 and resistor 158 of the delay monostable oscillator 136. As a result, capacitor 150 is charged only through resistor 158, thus rapidly charging capacitor 150 and reducing the delay time to permit substantially immediate testing of the sensors. At the same time, switch section 48A connects the positive terminal 66 of the power source 68 through diode 186, diode 190 and resistor 192 to capacitor 72 of the monostable oscillator 58, thereby substantially reducing the period of operation of monostable oscillator 58 in order to give a short test response. A short intrusion test response is also achieved by connecting terminal 2 of switch section 48A to capacitor 132 of monostable oscillator 124 through diode 186, diode 188, resistor 194 and diode 196. Hence, an intrusion will result in an almost immediate actuation of the alarm for a very short period. Section 48C of switch 48 grounds the input of amplifier 106 through resistor 98 in the second position, thereby providing variable muted audio sound only during the sensor test position.

Each of the loudspeakers 40 and 42 are connected to the positive terminal of the power source through a switch 200, and 202, respectively. A transistor switch 204 is connected in parallel with the switches 200 and 202, and the base of the transistor switch 204 is driven from the output of the fire monostable oscillator 58. In this manner, a fire detection will drive the inside and outside alarms even though switches 200 and 202 are open to sound a local alarm.

When the selector switch 48 is in the third position, the master control is programmed for the dialer test. The third position of section 48A of the selector switch places a positive potential on the bases of two transistors 206 and 208, both transistor switches having grounded emitters. Accordingly, transistor 206 grounds input 32 of the two channel dialer and message device 34, thereby preventing the unit from responding to an output on the fire monostable oscillator 58. In like manner, transistor 208 grounds input terminal 30 of the two channel dialer message device 34 thereby preventing the dialer from responding to an output of the intrustion monostable oscillator 124. A third transistor 210 also has a base connected to terminal 3 of switch section 48A, and transistor 210 grounds terminal 212 of connector 178 which is effective to initiate a test of the dialer itself by placing the dialer audio message on an internal dialer speaker. The fourth position of the selector switch 48 is disarm position in which the intrusion section of the master control becomes inoperative. The fire channel is operative.

The master control 22 contains networks for warning the user of unsafe operational conditions. Should the function switch 48 be left in either the sensor or dialer test position (positions 2 or 3), the control will not enter an alarm period. Therefore if switch 48 is in positions 2 or 3, a current flows from power source 68 through the switch section 48A and contacts 2 or 3, through diode 220 and resistor 222 to charge the capacitor 102 creating a sequence of current pulses through resistor 104 as heretofore stated. If the switch section 48A is in position 2, an audible click will be noted in the speaker, the sawtooth waveform appearing at the emitter of transistor 96 being applied to the trouble circuit 98. The sawtooth waveform is conducted through resistor 224 and applied across resistor 226 causing the transistor 100 to conduct at the crest of each waveform peak, thus illuminating the fire/trouble lamp 44. Since the waveform reaches a crest once per second, the trouble lamp 44 flashes once per second indicating trouble. Thus, a flashing trouble lamp 44 occurs at all times when switch 48A is in positions 2 or 3.

Fault detector also functions as described above in response to an open circuit across two fire terminals 228 and 230 provided for external fire detectors. If the circuit across terminals 228 and 230 opens, current flowing from the power supply 68 through resistor 232, and resistor 236 is interrupted causing the collector of transistor 238 to rise. This permits a current flow through resistor 240 and diode 242 to charge capacitor 102. The trouble lamp flashes at the rate of one flash per 2 seconds. During the flash an audible sound or click is developed in the speakers 42 and 40. When external fire detectors are not used, a resistor 234 is connected across terminals 228 and 230 to avoid an open circuit.

From the foregoing specification, those skilled in the art will readily devise many modifications and constructions intended to be within the scope of the present invention. It is therefore the following claims which define the present invention.

The invention claimed is:

1. A security device comprising in combination, a first monostable oscillator having an input terminal and an output terminal adapted to carry a potential thereon, the potential on the output terminal of the first monostable oscillator changing from a first potential to a second potential responsive to an electrical signal impressed on the input terminal of said first monostable oscillator and the output of said first monostable oscillator remaining at said second potential for a first period of time following each change to said second potential and returning to said first potential at the end of said first period of time, a sensor adapted to produce an electrical signal for actuating the first monostable oscillator electrically connected to the input terminal of said first monostable oscillator, an alarm electrically connected to the output terminal of the first monostable oscillator, said alarm being activated by the second output potential of the first monostable oscillator and inactivated by the first output potential of the first monostable oscillator, a second monostable oscillator having an input terminal electrically connected to the sensor and an output terminal adapted to carry a potential thereon, the potential on the output terminal of said second monostable oscillator changing from a third potential to a fourth potential responsive to an electrical signal impressed on the input terminal of said second monostable oscillator from the sensor and the potential on the output terminal of said second monostable oscillator remaining at said fourth potential for a second period of time and changing from said fourth potential to said third potential at the end of said second period of time, said second period of time being shorter than the first period of time, and means electrically connected to the output terminal of the second monostable oscillator for preventing actuation of the alarm during periods in which the fourth potential is applied to the output terminal of the second monostable oscillator, whereby actuation of the sensor results in actuation of the first and second monostable oscillators but actuation of the alarm is delayed during the second period of time.

2. A security device comprising the combination of claim 1 wherein said second monostable oscillator includes a capacitor and a capacitor charging circuit including a resistance element and a direct current power source connected in series with the capacitor, the second time period being determined by the time required for said capacitor to be charged to a threshold potential.

3. A security device comprising the combination of claim 2 in combination with a second capacitor charging circuit including a second resistance element and a direct current power source connected in series with said capacitor, the second resistance element having a different resistance than the first resistance element to change the charging time of said capacitor.

4. A security device comprising the combination of claim 3 wherein the direct current power source of the second charging circuit comprises the first monostable oscillator, the second charging circuit being connected to the output terminal of the first monostable oscillator.

5. A security device comprising the combination of claim 4 in combination with means electrically connected to the input terminal of the second monostable oscillator for actuating said second monostable oscillator independent of the first monostable oscillator.

6. A security device comprising the combination of claim 5 wherein said means for actuating said second monostable oscillator comprises a two terminal power source, an electrical switch having a plurality of stationary contacts and a non-shorting rotary contact connected to one terminal of the power source, a resistor connected between the other terminal of the power source and two adjacent stationary contacts, a second capacitor and a second resistor connected between said two adjacent contacts and the one terminal of the power source, the junction between said second capacitor and second resistor being connected to the input terminal of the second monostable oscillator.

7. A security device comprising the combination of claim 6 in combination with a normally open switch having a control terminal electrically connected to the output of the second monostable oscillator and two switch terminals adapted to close on actuation of the switch, one of said switch terminals being electrically coupled to the input of the first monostable oscillator and the other of said switch terminals being electrically coupled to the power source.

8. A security device comprising the combination of claim 1 wherein the first and the second monostable oscillators are each provided with a reset terminal and wherein a potential impressed upon said reset terminal sets the state of said oscillator to low output on the output terminal thereof, in combination with a two terminal direct current power source, a reset pulse generator having an output terminal electrically connected to the reset terminal of the first and second monostable oscillators and an input terminal, said input terminal being connected to one terminal of the power source through a resistor and to the other terminal of the power source through a second resistor, a capacitor, and a third resistor connected in series therebetween, and a diode connected between the capacitor and second resistor and the one terminal of the power source.

9. A security device comprising the combination of claim 1 wherein the alarm comprises an electrical astable oscillator having a first control terminal, a second control terminal, and an output terminal, the first control terminal being electrically connected to the output terminal of the first monostable oscillator, and the second control terminal being electrically connected to the output terminal of the second monostable oscillator, and a loudspeaker electrically connected to the output terminal of the astable oscillator, said astable oscillator producing an audio frequency output on its output terminal during periods in which the output terminal of the first monostable oscillator is at the second potential and the output terminal of the second monostable oscillator is at the third potential.

10. A security device comprising the combination of claim 9 in combination with a third monostable oscillator having an input terminal and an output terminal, the potential on the output terminal of said third monostable oscillator changing from a fifth potential to a sixth potential responsive to an electrical signal impressed on the input terminal of said monostable oscillator, the output of said third monostable oscillator remaining at said sixth potential for a period of time following each change to said sixth potential and returning to said fifth potential at the end of said time period, a second sensor adapted to produce an electrical signal for actuating said third monostable oscillator electrically connected to the input of said third monostable oscillator, and means electrically connecting the output terminal of said third monostable oscillator to the first control terminal of the astable oscillator.

11. A security device comprising the combination of claim 10 wherein the astable oscillator has a third control terminal, the frequency of the audio output of said astable oscillator being responsive to the magnitude of a potential impressed on said third control terminal, in combination with a sawtooth oscillator having a control terminal electrically connected to the output of the first monostable oscillator, said sawtooth oscillator having an output terminal electrically connected to the third control terminal of the astable oscillator.

12. A security device comprising the combination of claim 11 in combination with an switch means having a first and a second switch terminal and a control terminal, the control terminal being electrically connected to the output of the third monostable oscillator, the first and second switch terminals being electrically connected to the sawtooth oscillator to inactivate the sawtooth oscillator on closing of the electronic switch.

13. A security device comprising the combination of claim 12 in combination with a lamp connected in series with the switch means.

14. A security device comprising the combination of claim 13 wherein the output of the sawtooth oscillator is coupled to the control terminal of the switch means in combination with a condition sensor coupled to the input of the first monostable oscillator, and means responsive to an open circuit in the condition sensor for actuating the sawtooth oscillator.

* * * * *